US007191761B2

(12) United States Patent
Shibagaki et al.

(10) Patent No.: US 7,191,761 B2
(45) Date of Patent: Mar. 20, 2007

(54) CONTROL APPARATUS FOR INTERNAL COMBUSTION ENGINE

(75) Inventors: Nobuyuki Shibagaki, Toyota (JP); Zenichiro Mashiki, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/262,734

(22) Filed: Nov. 1, 2005

(65) Prior Publication Data

US 2006/0213482 A1 Sep. 28, 2006

(30) Foreign Application Priority Data

Nov. 2, 2004 (JP) ..... 2004-319115
Mar. 22, 2005 (JP) ..... 2005-081858

(51) Int. Cl.
*F02B 7/00* (2006.01)
*F02D 41/30* (2006.01)

(52) U.S. Cl. ..... 123/431; 123/481; 73/119 A

(58) Field of Classification Search ..... 123/479, 123/481, 198 D, 198 DB, 431, 299–300, 123/304–305, 525, 27 GE, 575; 701/103–105, 701/107; 73/119 A
See application file for complete search history.

(56) References Cited

U.S. PATENT DOCUMENTS 5,181,493 A 1/1993 Motoyama et al.
2006/0090732 A1* 5/2006 Shibagaki ..... 123/406.13
2006/0137649 A1* 6/2006 Shibagaki ..... 123/306
2006/0180128 A1* 8/2006 Saito et al. ..... 123/525

FOREIGN PATENT DOCUMENTS

| | | | |
|---|---|---|---|
| EP | 1 505 293 | * | 2/2005 |
| JP | A 59-206613 | | 11/1984 |
| JP | A 4-31647 | | 2/1992 |
| JP | A 7-293301 | | 11/1995 |
| JP | A 9-287525 | | 11/1997 |
| JP | A 2000-145516 | | 5/2000 |
| JP | A 2000-257496 | | 9/2000 |
| JP | 2005-146884 | * | 6/2005 |

* cited by examiner

*Primary Examiner*—Hai Huynh
(74) *Attorney, Agent, or Firm*—Oliff & Berridge, PLC

(57) ABSTRACT

An engine ECU executes a program including the steps of: determining presence of abnormality in a high-pressure fuel system; when abnormality is sensed in the high-pressure fuel system, and not in an in-cylinder injector, injecting fuel from the in-cylinder injector at the feed pressure; selecting criteria (1) that is the restriction standard for a more gentle output restriction of the engine; when abnormality is sensed in the high-pressure fuel system and in the in-cylinder injector, ceasing the in-cylinder injector; selecting criteria (2) that is the restriction standard for a stricter output restriction of the engine; increasing the VVT overlap; retarding the ignition timing; and restricting the throttle opening according to the selected criteria.

36 Claims, 8 Drawing Sheets

CONTROL APPARATUS FOR INTERNAL COMBUSTION ENGINE

This nonprovisional application is based on Japanese Patent Applications Nos. 2004-319115 and 2005-081858 filed with the Japan Patent Office on Nov. 2, 2004 and Mar. 22, 2005, respectively, the entire contents of which are hereby incorporated by reference.

BACKGROUND OF THE INVENTION

1. Field of the Invention

The present invention relates to an internal combustion engine including first fuel injection means (in-cylinder injector) for injecting fuel into a cylinder and second fuel injection means (intake manifold injector) for injecting fuel towards an intake manifold or intake port. Particularly, the present invention relates to the technique of obviating attachment of deposits at the injection hole of the first fuel injection means even in the event of abnormality in the fuel supply system that supplies fuel to the first fuel injection means.

2. Description of the Background Art

An internal combustion engine is well known, including an intake manifold injector for injecting fuel into the intake manifold of the engine and an in-cylinder injector for injecting fuel into the engine combustion chamber, wherein the fuel injection ratio of the intake manifold injector to the in-cylinder injector is determined based on the engine speed and engine load.

In the event of operation failure due to a malfunction of the in-cylinder injector or the fuel system that supplies fuel to the in-cylinder injector (hereinafter, referred to as high-pressure fuel supply system), fuel injection by the in-cylinder injector will be ceased.

On the basis of the fail-safe faculty in such operation failure, it is possible to ensure travel by inhibiting fuel injection from the in-cylinder injector and fix the combustion mode at the uniform combustion mode to effect fuel injection from the intake manifold injector alone. However, in the case where the intake manifold injector is set to take an auxiliary role of the in-cylinder injector, fuel of a quantity corresponding to the intake air at the time of full opening of the throttle valve cannot be supplied, whereby the air-fuel ratio in the fail-safe mode will become lean. There may be the case where the torque is insufficient due to combustion defect.

Japanese Patent Laying-Open No. 2000-145516 discloses an engine controlling device that can maintain the air-fuel ratio properly to obtain suitable driving power even during fuel injection control by the intake manifold injector alone in the fail-safe mode caused by operation failure of the in-cylinder injector. This engine controlling device includes an in-cylinder injector that directly injects fuel to the combustion chamber, an intake manifold injector that injects fuel to the intake system, and an electronic control type throttle valve. When the target fuel injection quantity set based on the engine operation state exceeds a predetermined injection quantity of the in-cylinder injector, the engine controlling device compensates for the insufficient quantity by fuel injection from the intake manifold injector. This engine controlling device also includes an abnormality determination unit determining abnormality of the in-cylinder injector and the high-pressure fuel supply system that supplies fuel to the in-cylinder injector, a target fuel correction unit comparing the maximum injection quantity of the intake manifold injector when abnormality is determined with the target fuel injection quantity to fix the target fuel injection quantity at the maximum injection quantity when the target fuel injection quantity exceeds the maximum injection quantity, a target intake air quantity correction unit calculating the target intake air quantity based on the target fuel injection quantity fixed at the maximum injection quantity and the target air-fuel ratio, and a throttle opening indication value calculation unit calculating the throttle opening indication value with respect to an electronic control type throttle valve based on the target intake air quantity.

When abnormality is sensed in the in-cylinder injector and the high-pressure fuel supply system that supplies fuel to the in-cylinder injector in this engine controlling device, the maximum injection quantity of the intake manifold injector is compared with the target fuel injection quantity that is set based on the engine operation state. When the target fuel injection quantity exceeds the maximum injection quantity, the target fuel injection quantity is fixed at the maximum injection quantity. The target intake air quantity is calculated based on this fixed target fuel injection quantity and target air-fuel ratio. The throttle opening indication value is calculated with respect to the electronic control type throttle valve based on the calculated target intake air quantity. Accordingly, when abnormality is sensed in the in-cylinder injector system, fuel injection from the in-cylinder injector is inhibited, and fuel is to be injected from only the intake manifold injector. Based on the maximum injection quantity at this stage and the target air-fuel ratio, the target intake air quantity is calculated. The throttle opening indication value with respect to the electronic control type throttle valve is calculated based on the target intake air quantity. In the fail-safe mode caused by failure in the in-cylinder injector system, the throttle opening will open only to the level corresponding to the target air-fuel ratio no matter how hard the acceleration pedal is pushed down. Thus, the air-fuel ratio is maintained properly to obtain suitable driving power.

It is to be noted that the engine controlling device disclosed in Japanese Patent Laying-Open No. 2000-145516 inhibits fuel injection from the in-cylinder injector to conduct fuel injection from only the intake manifold injector when malfunction occurs in the high-pressure fuel supply system. This induces the problem that deposits will be readily accumulated at the injection hole of the in-cylinder injector. The in-cylinder injector per se that was originally absent of failure, (for example, (1) even if failure originates from the high-pressure fuel supply system, or (2) failure originates from one of the plurality of in-cylinder injectors), will eventually malfunction due to the deposits accumulated at the injection hole of the in-cylinder injector.

In the engine controlling device disclosed in Japanese Patent Laying-Open No. 2000-145516, the target fuel injection quantity is fixed at the maximum injection quantity level of the intake manifold injector, and fuel is injected from the intake manifold injector at the maximum injection level. Since no measures to suppress deposits accumulating at the injection hole of the in-cylinder injector has been taken into account, an in-cylinder injector that was originally absent of failure will eventually malfunction due to deposits accumulating at the injection hole of the in-cylinder injector.

SUMMARY OF THE INVENTION

An object of the present invention is to provide a control apparatus for an internal combustion engine in which a first fuel injection mechanism that injects fuel into a cylinder and a second fuel injection mechanism that injects fuel to an intake manifold partake in fuel injection, suppressing further failure of the first fuel injection mechanism when failure occurs at the first fuel injection mechanism side including a fuel supply system towards the first fuel injection mechanism.

According to an aspect of the present invention, a control apparatus for an internal combustion engine controls the internal combustion engine that includes a first fuel injection mechanism injecting fuel into a cylinder, a second fuel injection mechanism injecting fuel into an intake manifold, a first fuel supply mechanism supplying fuel to the first fuel injection mechanism, and a second fuel supply mechanism supplying fuel to the first and second fuel injection mechanisms. The control apparatus includes a control unit controlling the first and second fuel injection mechanisms such that the first and second fuel injection mechanisms partake in fuel injection, including a state of injection from one of the first and second fuel injection mechanisms being ceased, a first abnormality determination unit determining presence of abnormality in the first fuel supply mechanism, and a second abnormality determination unit determining presence of abnormality in the first fuel injection mechanism. The control unit effects control such that fuel is injected from at least the first fuel injection mechanism using the second fuel supply mechanism when the first abnormality determination unit determines presence of abnormality in the first fuel supply system and the second abnormality determination unit does not determine presence of abnormality in the first fuel injection mechanism.

In accordance with the present invention, the injection hole at the leading end of the first fuel injection mechanism (in-cylinder injector) identified as a fuel injection mechanism for injecting fuel into a cylinder of the internal combustion engine is located inside the combustion chamber. Attachment of deposits is promoted at a high temperature region and/or a high concentration region of nitrogen oxide (NOx). The desired quantity of fuel cannot be injected if such deposits are accumulated. Deposits are readily accumulated if fuel injection from the in-cylinder injector is ceased. In contrast, deposits are not readily accumulated when fuel is injected from the in-cylinder injector. Fuel is supplied to this in-cylinder injector from a first fuel supply mechanism that is a fuel supply system including a high-pressure pump injecting fuel at a compression stroke and a second fuel supply mechanism identified as a fuel supply system including a feed pump that supplies fuel from a fuel tank to the high-pressure pump. Conventionally, in the event of an error at the first fuel supply mechanism, fuel injection from the in-cylinder injector is inhibited, and fuel is injected out from the second fuel injection mechanism (intake manifold injector) alone. Therefore, an in-cylinder injector that was originally absent of failure would eventually malfunction due to the accumulating deposits that block the injection hole of the in-cylinder injector. In view of this problem, the control unit of the present invention effects control such that fuel is injected at an intake stroke, for example, from the first fuel injection mechanism using the second fuel supply mechanism. Therefore, the problem of accumulation of deposits at the injection hole of the in-cylinder injector can be obviated since fuel injection from the in-cylinder injector is not ceased. Thus, there is provided a control apparatus for an internal combustion engine in which the first fuel injection mechanism injecting fuel into the cylinder and the second fuel injection mechanism injecting fuel into an intake manifold partake in fuel injection, suppressing further failure of the first fuel injection mechanism when failure occurs at the first fuel injection mechanism side including the fuel supply system to the first fuel injection mechanism.

Preferably, the control unit effects control to suppress fuel supply from the first fuel injection mechanism when the first abnormality determination unit determines presence of abnormality in the first fuel supply mechanism and the second abnormality determination unit determines presence of abnormality in the first fuel injection mechanism.

Since fuel injection from the in-cylinder injector is not ceased unless determination is made of abnormality in the in-cylinder injector in the present invention, accumulation of deposits at the injection hole of the in-cylinder injector can be obviated.

More preferably, the control apparatus further includes an adjustment unit adjusting a variable valve timing mechanism (VVT) provided at the internal combustion engine such that overlap of intake valves and exhaust valves is increased when the first abnormality determination unit determines presence of abnormality in the first fuel supply mechanism as compared to the case where determination is made of no abnormality in the first fuel supply mechanism.

By increasing the overlap of the intake valves and exhaust valves in the present invention, the internal EGR (Exhaust Gas Recirculation) increases to reduce the combustion temperature, whereby generation of NOx is suppressed. When determination is made of abnormality in the first fuel supply mechanism such that fuel injection from the in-cylinder injector is to be ceased, the valve overlap is increased as set forth above to increase the internal EGR and reduce the combustion temperature, whereby generation of NOx is suppressed. By reducing the combustion temperature and suppressing NOx, accumulation of deposits at the injection hole of the in-cylinder injector can be suppressed.

Further preferably, the control apparatus further includes an adjustment unit adjusting the ignition timing such that, when the first abnormality determination unit determines presence of abnormality in the first fuel supply mechanism, the ignition timing is retarded as compared to the case where determination is made of no abnormality in the first fuel supply mechanism.

In accordance with the present invention, the ignition timing is retarded and the combustion temperature is reduced to suppress generation of NOx. By retarding the ignition timing as compared to the case where the ignition timing is set in the vicinity of MBT (Minimum spark advance for Best Torque) where the combustion pressure is highest and the combustion temperature is also high, the combustion pressure and the combustion temperature are reduced, allowing suppression of NOx generation. By such reduction in combustion temperature and suppression of NOx, accumulation of deposits at the injection hole of the in-cylinder injector can be suppressed.

Further preferably, the control apparatus further includes a restriction unit restricting the output of the internal combustion engine such that deposits are not accumulated at the injection hole of the first fuel injection mechanism.

When there is abnormality in the first fuel supply mechanism in the present invention, the output of the internal combustion engine is restricted to cause reduction of the temperature at the leading end of the in-cylinder injector (combustion temperature) and suppress NOx in order to obviate accumulation of deposits at the in-cylinder injector. Therefore, accumulation of deposits at the injection hole of the in-cylinder injector can be suppressed. Even in the case where fuel injection from the in-cylinder injector is ceased to attain a state in which deposits are apt to accumulate, fuel injection from the intake manifold injector is suppressed such that deposits are not accumulated at the injection hole of the in-cylinder injector. The problem of the injection hole of the in-cylinder injector being blocked by deposits can be obviated even after running in a mode in which the output of the internal combustion engine is restricted.

Further preferably, the restriction unit modifies the restriction of the output of the internal combustion engine between an event of ceasing fuel injection from the first fuel injection mechanism and an event of conducting fuel injection from the first fuel injection mechanism using the second fuel supply mechanism to restrict the internal combustion engine output.

In accordance with the present invention, in a fuel injection inhibited mode in which deposits are likely to be accumulated at the injection hole of the in-cylinder injector, output of the internal combustion engine, for example, is restricted stricter than when fuel injection is not ceased. The output of the internal combustion engine is restricted even in a state where deposits are likely to be accumulated at the injection hole. Thus, accumulation of deposits at the injection hole of the in-cylinder injector is prevented.

Further preferably, the restriction unit modifies restriction of the output of the internal combustion engine to become stricter when fuel supply from the first fuel injection mechanism is ceased than in the case where fuel injection is conducted from the first fuel injection mechanism using the second fuel supply mechanism to restrict output of the internal combustion engine.

In a fuel injection inhibited mode in which deposits will be accumulated more readily at the injection hole of the in-cylinder injector in the present invention, output of the internal combustion engine is further restricted than in the case where fuel injection is not ceased. The output of the internal combustion engine is suppressed even in a state where deposits are likely to be accumulated at the injection hole. Thus, accumulation of deposits at the injection hole of the in-cylinder injector is prevented.

According to another aspect of the present invention, a control apparatus for an internal combustion engine controls the internal combustion engine including a first fuel injection mechanism injecting fuel into a cylinder and a second fuel injection mechanism injecting fuel into an intake manifold. The control apparatus includes an injection control unit controlling the first and second fuel injection mechanisms such that the first and second fuel injection mechanisms partake in fuel injection, including a state of injection from one of the first and second fuel injection mechanisms being ceased, a sense unit sensing that the first fuel injection mechanism cannot operate properly, and a control unit controlling the internal combustion engine such that the temperature in the cylinder of the internal combustion engine is reduced when the first fuel injection mechanism cannot operate properly.

In accordance with the present invention, the injection hole at the leading end of the first fuel injection mechanism (in-cylinder injector) identified as a fuel injection mechanism for injecting fuel into a cylinder of the internal combustion engine is located inside the combustion chamber. Attachment of deposits is promoted at a high temperature region. The desired quantity of fuel cannot be injected if such deposits are accumulated. When fuel injection from the in-cylinder injector is suppressed and the temperature in the cylinder is high, deposits will be readily accumulated, promoting breakdown of the in-cylinder injector per se. When error occurs at the injection system of the in-cylinder injector or the fuel system of the in-cylinder injector, fuel injection from the in-cylinder injector is inhibited, or fuel was injected at the feed pressure. Both correspond to the case where the in-cylinder injector cannot operate properly. In such a case, cooling through the fuel is not effected since fuel is not injected from the in-cylinder injector. Therefore, an in-cylinder injector that was originally absent of failure will eventually malfunction due to accumulation of the deposits that block the injection hole of the in-cylinder injector or due to the high temperature. In such a case, the control unit controls the internal combustion engine such that the temperature in the cylinder of the internal combustion engine is reduced. Therefore, the problem of the in-cylinder injector attaining extremely high temperature can be obviated even in the case where fuel injection from the in-cylinder injector is ceased or in the case where injection can be conducted only at the feed pressure. Thus, there is provided a control apparatus for an internal combustion engine in which the first fuel injection mechanism injecting fuel into the cylinder and the second fuel injection mechanism injecting fuel into an intake manifold partake in fuel injection, suppressing further failure of the first fuel injection mechanism.

Preferably, the control unit controls the internal combustion engine such that the temperature in the cylinder of the internal combustion engine is reduced, based on the temperature of the first fuel injection mechanism.

In accordance with the present invention, the temperature of the first fuel injection mechanism (in-cylinder injector) is calculated (estimated and measured), and the internal combustion engine is controlled such that the temperature in the in-cylinder is reduced to avoid excessive increase of the temperature (avoid exceeding the threshold value). Thus, further failure of the in-cylinder injector is suppressed.

Further preferably, the temperature of the first fuel injection mechanism is calculated based on the engine speed and intake air quantity of the internal combustion engine.

In the present invention, the temperature of the in-cylinder injector is calculated higher as the engine speed and the intake air quantity of the internal combustion engine are higher, and calculated lower as the engine speed and the intake air quantity of the internal combustion engine are lower.

Further preferably, the temperature of the first fuel injection mechanism is calculated by the temperature calculated based on the engine speed and the intake air quantity of the internal combustion engine, and the temperature variation factor.

In accordance with the present invention, the basic temperature of the in-cylinder injector is calculated based on the engine speed and the intake air quantity of the internal combustion engine. The temperature of the in-cylinder injector is calculated taking into consideration the temperature variation factor that is the cause of reducing or increasing the temperature.

Further preferably, the temperature variation factor is a correction temperature calculated based on at least one of the overlapping amount of the intake valves and exhaust valves and the retarded amount of the ignition timing.

In accordance with the present invention, the internal EGR is increased to reduce the combustion temperature when the overlap of the intake valves and exhaust valves is great. The combustion temperature is reduced also in the case where the ignition timing is retarded. Taking into consideration the temperature variation factor that is the cause of reducing the temperature, the temperature of the in-cylinder injector is calculated.

Further preferably, the control unit controls the internal combustion engine such that the temperature in the cylinder of the internal combustion engine is reduced by restricting the intake air quantity into the internal combustion engine.

By restricting the intake air quantity into the internal combustion engine, the output of the internal combustion engine can be restricted to allow reduction of the temperature in the cylinder.

Further preferably, the control unit controls the internal combustion engine such that the temperature in the cylinder of the internal combustion engine is reduced by restricting the engine speed of the internal combustion engine.

In accordance with the present invention, the internal combustion engine output is restricted by restricting the engine speed of the internal combustion engine, allowing reduction of the temperature in the cylinder.

Further preferably, the control apparatus has the temperature of the internal combustion engine reduced by the control unit when the temperature of the first fuel injection mechanism is higher than a predetermined temperature.

In accordance with the present invention, the temperature in the cylinder of the internal combustion engine can be reduced when the temperature of the in-cylinder injector is high.

Further preferably, the first fuel injection mechanism is an in-cylinder injector, and the second fuel injection mechanism is an intake manifold injector.

In an internal combustion engine in which an in-cylinder injector identified as the first fuel injection mechanism and an intake manifold injector identified as the second fuel injection mechanism partake in fuel injection, fuel injection from the in-cylinder injector is not ceased even in the case where the first fuel supply mechanism (for example, high-pressure pump) that supplies fuel to the in-cylinder injector fails, or when one of the plurality of in-cylinder injectors fails. Therefore, a control apparatus for an internal combustion engine suppressing further failure of the in-cylinder injector can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
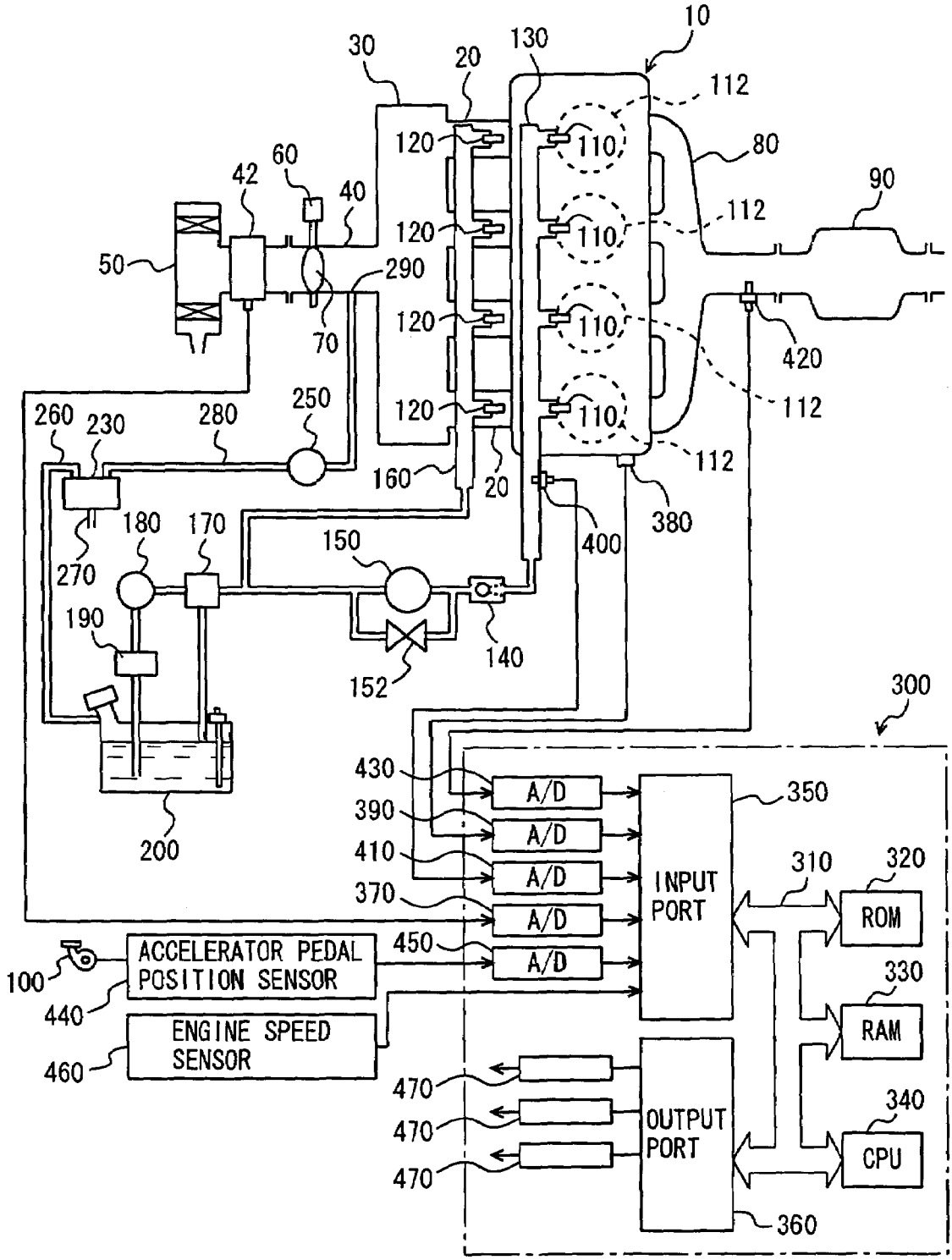
FIG. 1 is a schematic diagram showing a structure of an engine system under control of the control apparatus according to an embodiment of the present invention.

Embodiments of the present invention will be described hereinafter with reference to the drawings. The same components have the same reference characters allotted, and their designation and function are also identical. Therefore, detailed description thereof will not be repeated.

FIG. 1 is a schematic view of a structure of an engine system under control of an engine ECU (Electronic Control Unit) identified as a control apparatus for an internal combustion engine according to an embodiment of the present invention. Although an in-line 4-cylinder gasoline engine is indicated as the engine, the present invention is not limited to such an engine.

As shown in FIG. 1, the engine 10 includes four cylinders 112, each connected to a common surge tank 30 via a corresponding intake manifold 20. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. Although an internal combustion engine having two injectors separately provided is explained in the present embodiment, the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is ceased. Electromagnetic spill valve 152 is controlled based on an output signal of engine ECU 300.

Specifically, the closing timing during a pressurized stroke of electromagnetic spill valve 152 provided at the pump intake side of high-pressure fuel pump 150 that applies pressure on the fuel by the vertical operation of a pump plunger through a cam attached to a cam shaft is feedback-controlled through engine ECU 300 using a fuel pressure sensor 400 provided at fuel delivery pipe 130, whereby the fuel pressure in fuel delivery pipe 130 (fuel pressure) is controlled. In other words, by controlling electromagnetic spill valve 152 through engine ECU 300, the quantity and pressure of fuel supplied from high-pressure fuel pump 150 to fuel delivery pipe 130 are controlled.

Each intake manifold injector 120 is connected to a common fuel delivery pipe 160 at the low pressure side. Fuel delivery pipe 160 and high-pressure fuel pump 150 are connected to an electromotor driven type low-pressure fuel pump 180 via a common fuel pressure regulator 170. Low-pressure fuel pump 180 is connected to fuel tank 200 via fuel filter 190. When the fuel pressure of fuel ejected from low-pressure fuel pump 180 becomes higher than a predetermined set fuel pressure, fuel pressure regulator 170 returns a portion of the fuel output from low-pressure fuel pump 180 to fuel tank 200. Accordingly, the fuel pressure supplied to intake manifold injector 120 and the fuel pressure supplied to high-pressure fuel pump 150 are prevented from becoming higher than the set fuel pressure.

Engine ECU 300 is based on a digital computer, and includes a ROM (Read Only Memory) 320, a RAM (Random Access Memory) 330, a CPU (Central Processing Unit) 340, an input port 350, and an output port 360 connected to each other via a bidirectional bus 310.

Air flow meter 42 generates an output voltage in proportion to the intake air. The output voltage from air flow meter 42 is applied to input port 350 via an A/D converter 370. A coolant temperature sensor 380 producing an output voltage in proportion to the engine coolant temperature is attached to engine 10. The output voltage from coolant temperature sensor 380 is applied to input port 350 via an A/D converter 390.

A fuel pressure sensor 400 producing an output voltage in proportion to the fuel pressure in high pressure delivery pipe 130 is attached to high pressure delivery pipe 130. The output voltage from fuel pressure sensor 400 is applied to input port 350 via an A/D converter 410. An air-fuel ratio sensor 420 producing an output voltage in proportion to the oxygen concentration in the exhaust gas is attached to exhaust manifold 80 upstream of 3-way catalytic converter 90. The output voltage from air-fuel ratio sensor 420 is applied to input port 350 via an A/D converter 430.

Air-fuel ratio sensor 420 in the engine system of the present embodiment is a full-range air-fuel ratio sensor (linear air-fuel sensor) producing an output voltage in proportion to the air-fuel ratio of air-fuel mixture burned at engine 10. Air-fuel ratio sensor 420 may be an $O_2$ sensor that detects whether the air-fuel ratio of air-fuel mixture burned at engine 10 is rich or lean to the stoichiometric ratio in an on/off manner.

An accelerator pedal position sensor 440 producing an output voltage in proportion to the pedal position of an accelerator pedal 100 is attached to accelerator pedal 100. The output voltage from accelerator pedal position sensor 440 is applied to input port 350 via an A/D converter 450. A revolution speed sensor 460 generating an output pulse representing the engine speed is connected to input port 350. ROM 320 of engine ECU 300 stores the value of the fuel injection quantity set corresponding to an operation state, a correction value based on the engine coolant temperature, and the like that are mapped in advance based on the engine load factor and engine speed obtained through accelerator pedal position sensor 440 and revolution speed sensor 460 set forth above.

A canister 230 that is a vessel for trapping fuel vapor dispelled from fuel tank 200 is connected to fuel tank 200 via a paper channel 260. Canister 230 is further connected to a purge channel 280 to supply the fuel vapor trapped therein to the intake system of engine 10. Purge channel 280 communicates with a purge port 290 that opens downstream of throttle valve 70 of intake duct 40. As well known in the field of art, canister 230 is filled with an adsorbent (activated charcoal) adsorbing the fuel vapor. An air channel 270 to introduce air into canister 230 via a check valve during purging is formed in canister 230. Further, a purge control valve 250 controlling the amount of purging is provided in purge channel 280. The opening of purge control valve 250 is under duty control by engine ECU 300, whereby the amount of fuel vapor that is to be purged in canister 230, and in turn the quantity of fuel introduced into engine 10 (hereinafter, referred to as purge fuel quantity), is controlled.

Figure 2:
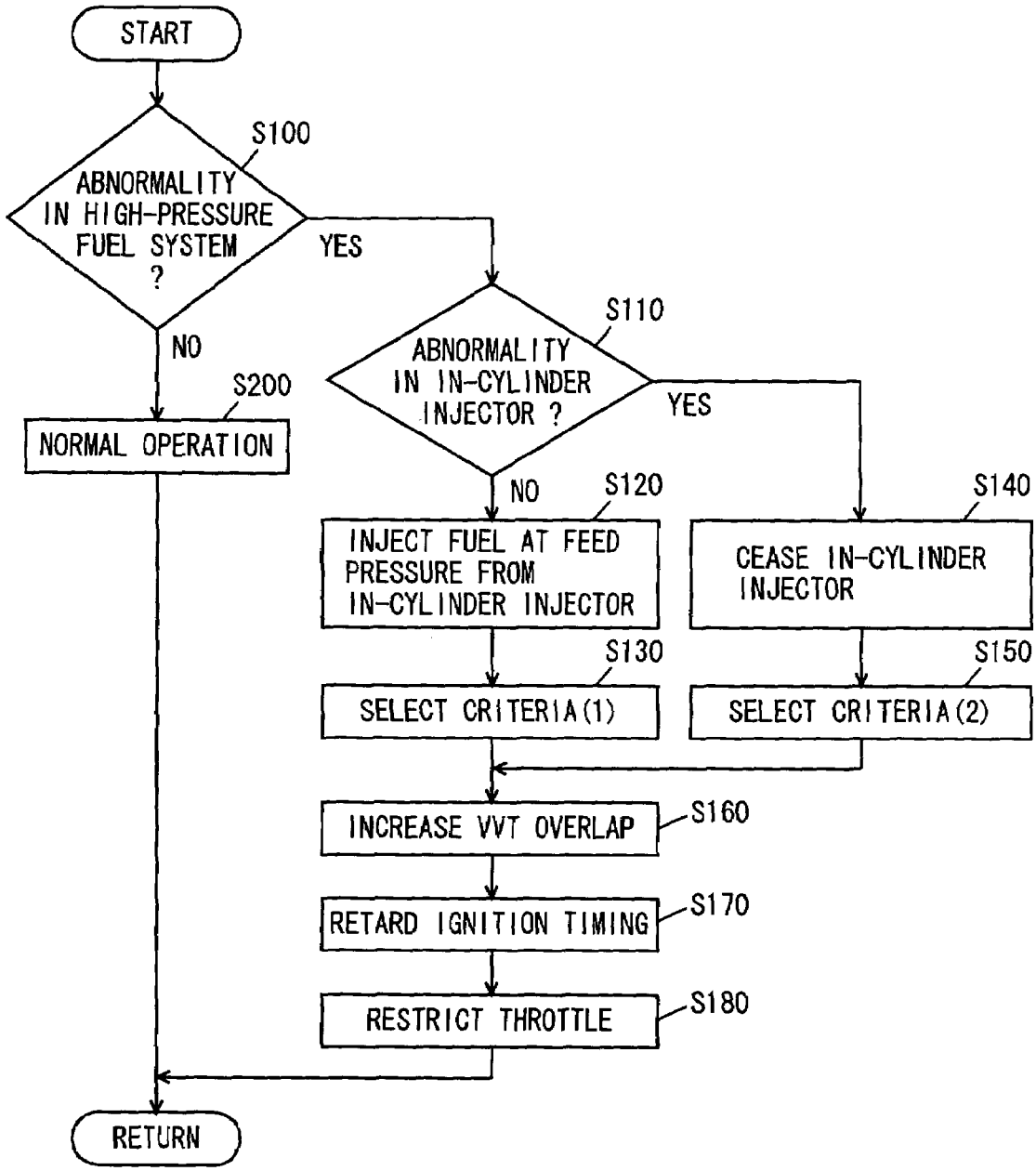
FIG. 2 is a flow chart of a control structure of a program executed by an engine ECU that is the control apparatus according to an embodiment of the present invention.

A control structure of a program executed by engine ECU 300 identified as the control apparatus of the present embodiment will be described with reference to FIG. 2. The program in this flow chart is executed at a predetermined interval of time, or at a predetermined crank angle of engine 10.

At step (hereinafter, step abbreviated as S) 100, engine ECU 300 determines whether abnormality in the high-pressure fuel system is sensed or not. For example, abnormality in the high-pressure fuel system is sensed when the engine-driven type high-pressure fuel pump fails so that the fuel pressure sensed by a fuel pressure sensor 400 is below a predetermined threshold value, or when the feedback control executed using fuel pressure sensor 400 is not proper. When abnormality in the high-pressure fuel system is sensed (YES at S100), control proceeds to S110, otherwise (NO at S100), control proceeds to S200.

At S110, engine ECU 300 determines whether abnormality in in-cylinder injector 110 is sensed or not. For example, abnormality in in-cylinder injector 110 is sensend, caused by disconnection of a harness or the like that transmits a control signal to in-cylinder injector 110. When abnormality in in-cylinder injector 110 is sensed (YES at S110), control proceeds to S140, otherwise (NO at S110), control proceeds to S120.

At S120, engine ECU 300 injects fuel supplied by an electromotor driven type low-pressure fuel pump 180 (feed pump) out from in-cylinder injector 110. Specifically, in-cylinder injector 110 injects fuel at the feed pressure. At S130, engine ECU 300 select criteria (1) as the standard employed for throttle restriction. Then, control proceeds to S160.

At S140, engine ECU 300 inhibits fuel injection from in-cylinder injector 110. Specifically, determination is made that in-cylinder injector 110 per se has failed, and injection is not conducted even at the feed pressure. At S150, engine ECU 300 selects criteria (2) as the standard used for throttle restriction. Then, control proceeds to S160.

At S160, engine ECU 300 increases the overlap of the intake valves and exhaust valves by VVT. Accordingly, the internal EGR is increased to realize reduction in the combustion temperature and NOx. At S170, engine ECU 300 retards the ignition timing. Accordingly, reduction of the combustion temperature and NOx can be realized.

At S180, engine ECU 300 restricts the opening of throttle valve 70. This means that the output of engine 10 is restricted. Accordingly, the intake air quantity is reduced (on the basis of a stoichiometric state), and the fuel injection quantity is reduced. Increase of the temperature at the leading end of in-cylinder injector 110 and generation of NOx can be suppressed. Therefore, accumulation of deposits at the injection hole of in-cylinder injector 110 can be suppressed. The criterion employed at this stage is (1) or (2), which will be described afterwards.

At S200, engine ECU 300 controls engine 10 so as to execute a normal operation.

Figure 3:
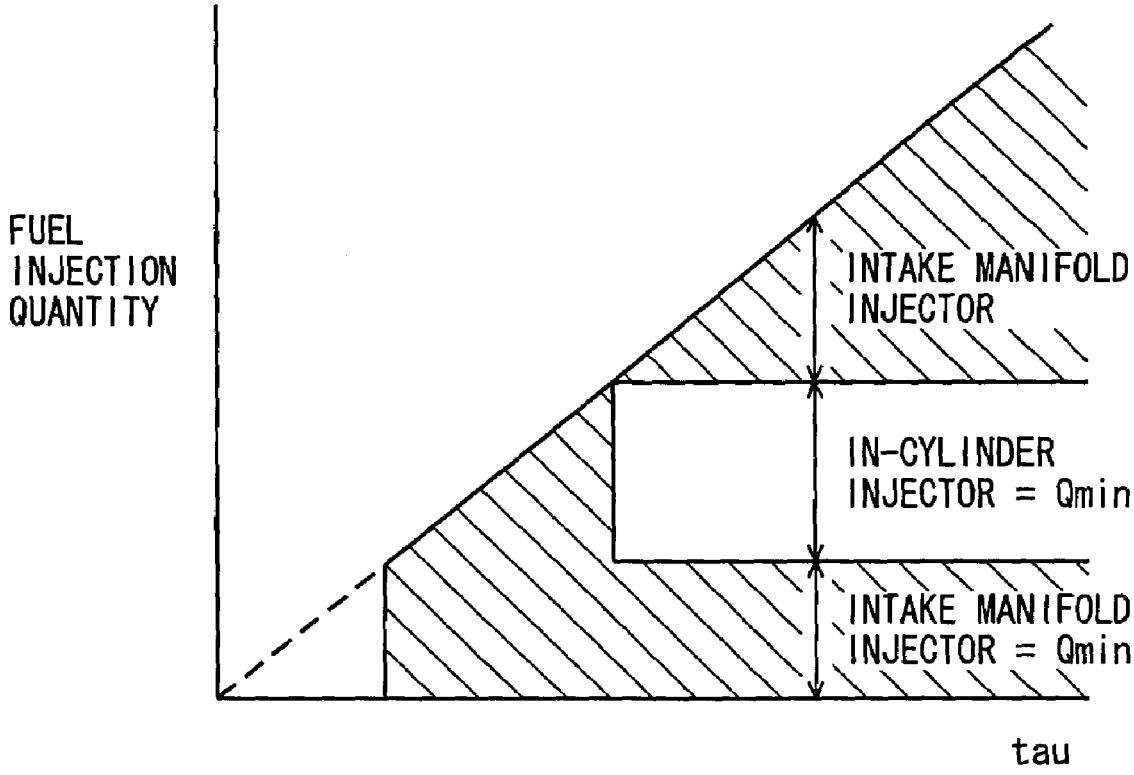
FIG. 3 represents the relationship between the fuel injection time and injection quantity.

The operation of engine 10 under control of engine ECU 300 identified as the control apparatus for an internal combustion engine of the present embodiment based on the structure and flow chart set forth above will be described here with reference to FIGS. 3 and 4.

When high-pressure fuel pump 150 or a valve provided at a delivery system thereof, for example, fails (YES at S100), determination is made whether abnormality in in-cylinder injector 110 is sensed or not.

<In the Case of Abnormality in High-Pressure Fuel System, and Not in In-Cylinder Injector>

When determination is made of no abnormality in in-cylinder injector 110 (NO at S110), in-cylinder injector 110 injects fuel at the feed pressure (S120). An example of the injected amount of fuel at this stage is shown in FIG. 3. FIG. 3 represents the relationship between fuel injection time tau and the fuel injection quantity. Since in-cylinder injector 110 is not malfunctioning, in-cylinder injector 110 partakes in fuel injection. This corresponds to "in-cylinder injector=Qmin" in FIG. 3. The remaining fuel is injected from intake manifold injector 120 with both the fuel supply system and injector functioning properly.

Figure 4:
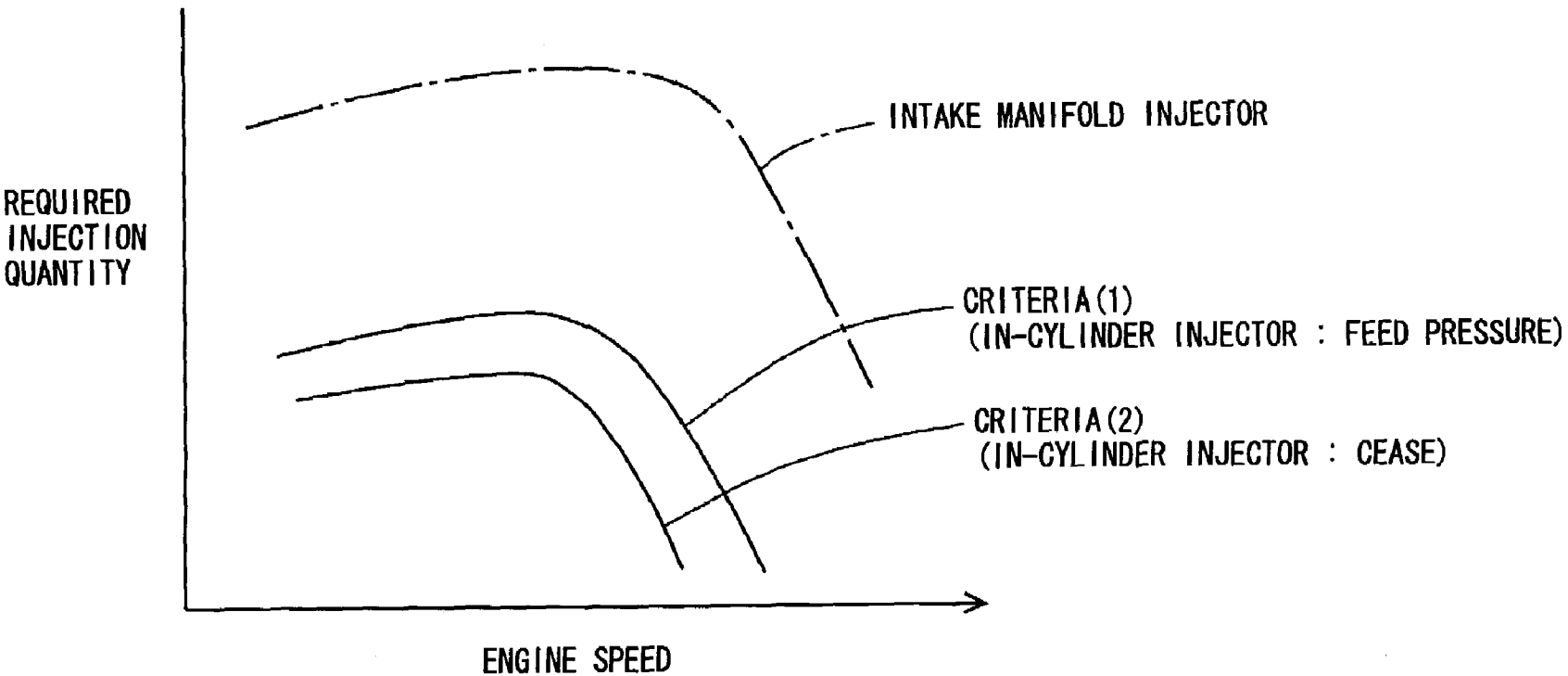
FIG. 4 represents the relationship between the engine speed and required injection quantity.

The chain dotted line in FIG. 4 corresponds to a version of conventional art. Fuel injection from in-cylinder injector 110 is inhibited, and engine 10 is controlled within the region indicated by the chain dotted line (the lower side region of the chain dotted line) from intake manifold injector 120 alone. In the present embodiment, the standard of criteria (1) is selected when fuel is to be injected from in-cylinder injector 110 at the feed pressure, and the standard of criteria (2) is selected when in-cylinder injector 110 is ceased. In other words, engine 10 is controlled within a region (the lower side region of the solid line) indicated by either criteria depending upon whether fuel is injected from in-cylinder injector 110 or not.

Criteria (1) and criteria (2) are independent of Qmin. The difference between criteria (1) and criteria (2) of FIG. 4 compensates for difference in the liability to clogging at the injector caused by in-cylinder injector 110 being ceased. In other words, criteria (1) includes margin with respect to injector clogging since in-cylinder injector 110 is operating for fuel injection, corresponding to the operation and fuel injection by in-cylinder injector 110. This means that more fuel can be injected.

Criteria (1) of FIG. 4 is selected (S130), and control is effected such that the overlap of the intake valves and exhaust valves is increased by VVT (S160). The ignition timing is retarded (S170), and the output of engine 10 is restricted to correspond to the required injection quantity of the region at the side lower than the solid line indicating criteria (1) of FIG. 4. Assuming that combustion is conducted at the stoichiometric state, the opening of throttle valve 70 is set smaller since a constant relationship is established between the fuel quantity and intake air quantity.

By increasing the overlap of the intake valves and exhaust valves, the internal EGR is increased to lower the combustion temperature, whereby generation of NOx is suppressed. By retarding the ignition timing, the combustion temperature can be reduced to suppress generation of NOx. By reduction in combustion temperature and suppression of NOx, accumulation of deposits at the injection hole of the in-cylinder injector can be suppressed. As indicated by the chain dotted line in FIG. 4 corresponding to the conventional case, restriction of fuel injection (required injection quantity) from intake manifold injector 120 did not take deposits at in-cylinder injector 110 into account. When fuel is injected at the feed pressure using in-cylinder injector 110 in the present embodiment, engine 10 is controlled within the range of criteria (1) corresponding to the region where the required injection quantity is more restricted with respect to the engine speed than in the conventional case. Accordingly, the temperature at the leading end of the in-cylinder injector (combustion temperature) is reduced to suppress NOx, whereby accumulation of deposits at the injection hole of the in-cylinder injector can be suppressed.

<In the Case of Abnormality in Both High-Pressure Fuel System and In-Cylinder Injector>

When determination is made of abnormality in in-cylinder injector 110 (YES at S110), fuel injection from in-cylinder injector 110 is ceased (S140).

Criteria (2) of FIG. 4 is selected (S150). Control is effected such that the overlap of the intake valves and exhaust valves increases by VVT (S160). The ignition timing is retarded (S170). The output of engine 10 is restricted to correspond to the required injection quantity of the region at the side lower than the solid line indicating criteria (2) of FIG. 4. Assuming that combustion is conducted at the stoichiometric state as mentioned above, the opening of throttle valve 70 is set smaller since a constant relationship is established between the fuel quantity and intake air quantity.

Particularly in the case where in-cylinder injector 110 is ceased, criteria (2) that has a stricter restriction than criteria (1) corresponding to the case where fuel is injected at the feed pressure from in-cylinder injector 110 is selected. Thus, the required injection quanity is further restricted, as shown in FIG. 4. By further restricting the amount of fuel injected from intake manifold injector 120, accumulation of deposits can be suppressed even in the state where deposits are apt to be more readily accumulated at the injection hole due to inhibition of fuel injection from in-cylinder injector 110.

Thus, even when error occurs at the fuel supply system that supplies fuel to the in-cylinder injector, fuel can be supplied to the in-cylinder injector for injection by the feed pump as long as the in-cylinder injector is proper. Accordingly, accumulation of deposits at the injection hole of the in-cylinder injector can be obviated. At this stage, the overlap of the intake valves and exhaust valves is increased by VVT, and the ignition timing is retarded, whereby combustion temperature is reduced and generation of NOx is suppressed to obviate accumulation of deposits. Additionally, the required fuel quantity is reduced based on criteria (1) to reduce the combustion temperature and suppress generation of NOx. Thus, accumulation of deposits is suppressed. Further, fuel injection from the in-cylinder injector is ceased if abnormality is detected therein in addition to occurrence of an error at the fuel supply system that supplies fuel to the in-cylinder injector. In this case, criteria (2) with a restriction stricter than criteria (1) is employed to further reduce the required fuel quantity, whereby the combustion temperature is reduced and generation of NOx is suppressed. Accordingly, accumulation of deposits at the in-cylinder injector that is inhibited of fuel injection can be suppressed.

<Engine (1) to Which Present Control Apparatus can be Suitably Applied>

An engine (1) to which the control apparatus of the present embodiment is suitably adapted will be described hereinafter.

Figure 5:
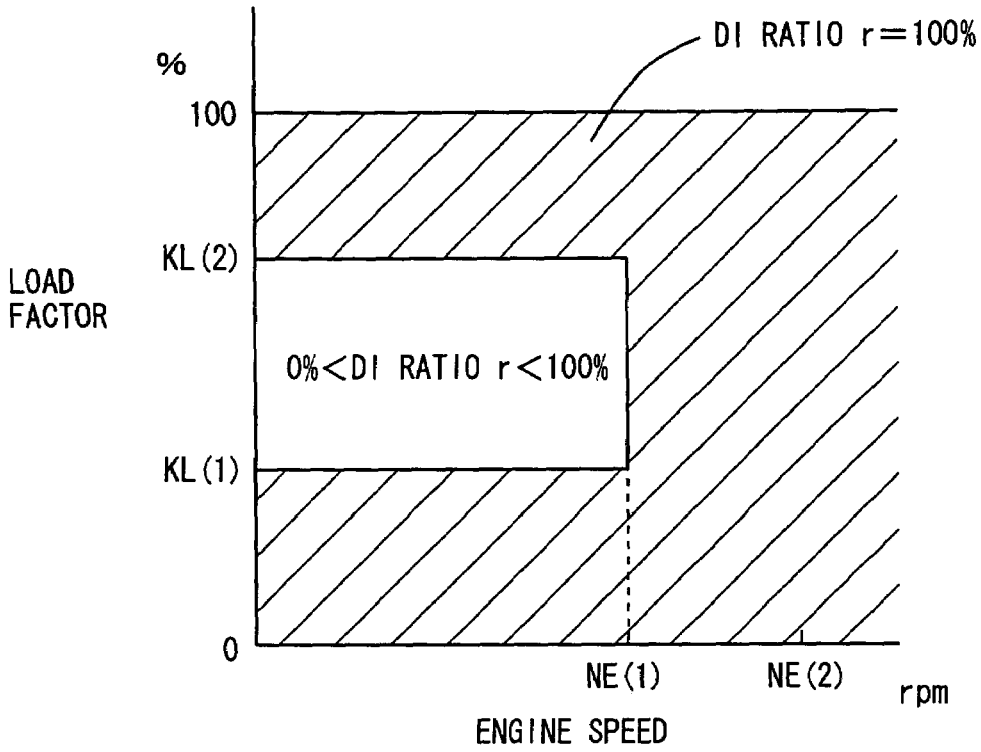
FIG. 5 represents a DI ratio map corresponding to a warm state of an engine to which the control apparatus of an embodiment of the present invention is suitably adapted.
Figure 6:
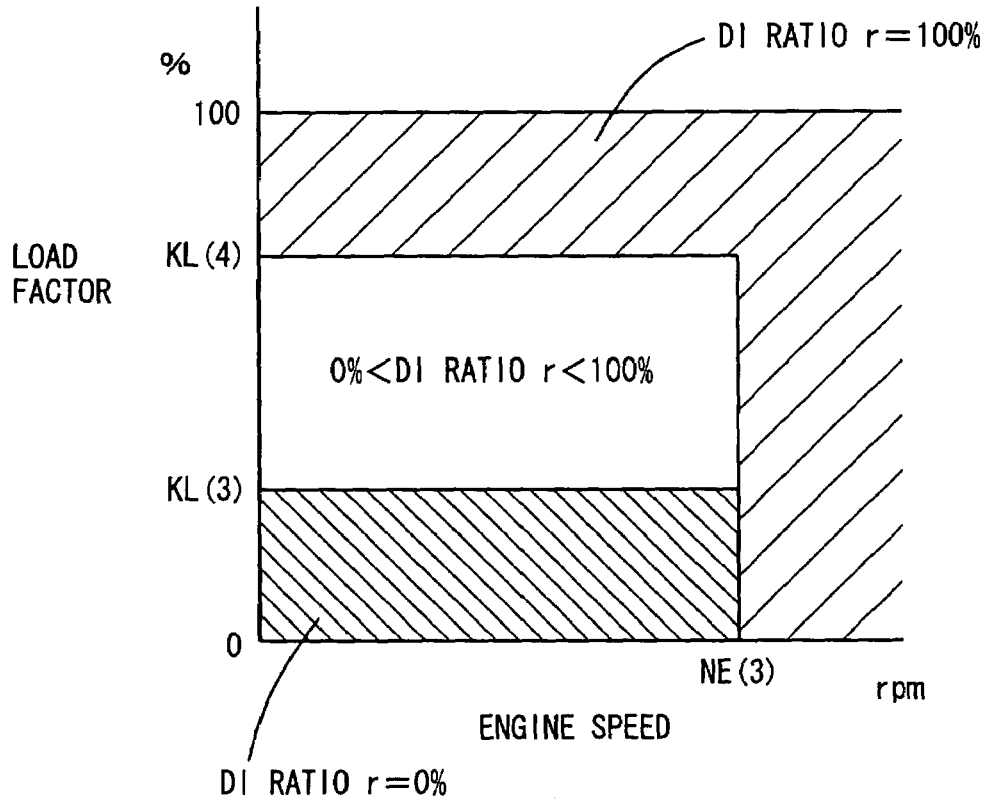
FIG. 6 represents a DI ratio map corresponding to a cold state of an engine to which the control apparatus of an engine of the present invention is suitably adapted.

Referring to FIGS. 5 and 6, maps indicating a fuel injection ratio (hereinafter, also referred to as DI ratio (r))

between in-cylinder injector 110 and intake manifold injector 120, identified as information associated with an operation state of engine 10, will now be described. The maps are stored in an ROM 320 of an engine ECU 300. FIG. 5 is the map for a warm state of engine 10, and FIG. 6 is the map for a cold state of engine 10.

In the maps of FIGS. 5 and 6, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 5 and 6, the DI ratio r is set for each operation region that is determined by the engine speed and the load factor of engine 10. "DI RATIO r=100%" represents the region where fuel injection is carried out from in-cylinder injector 110 alone, and "DI RATIO r=0%" represents the region where fuel injection is carried out from intake manifold injector 120 alone. "DI RATIO r≠0%", "DI RATIO r≠100%" and "0%<DI RATIO r<100%" each represent the region where in-cylinder injector 110 and intake manifold injector 120 partake in fuel injection. Generally, in-cylinder injector 110 contributes to an increase of power performance, whereas intake manifold injector 120 contributes to uniformity of the air-fuel mixture. These two types of injectors having different characteristics are appropriately selected depending on the engine speed and the load factor of engine 10, so that only homogeneous combustion is conducted in the normal operation state of engine 10 (for example, a catalyst warm-up state during idling is one example of an abnormal operation state).

Further, as shown in FIGS. 5 and 6, the DI ratio r of in-cylinder injector 110 and intake manifold injector 120 is defined individually in the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 5 is selected; otherwise, the map for the cold state shown in FIG. 6 is selected. In-cylinder injector 110 and/or intake manifold injector 120 are controlled based on the engine speed and the load factor of engine 10 in accordance with the selected map.

The engine speed and the load factor of engine 10 set in FIGS. 5 and 6 will now be described. In FIG. 5, NE(1) is set to 2500 rpm to 2700 rpm, KL(1) is set to 30% to 50%, and KL(2) is set to 60% to 90%. In FIG. 6, NE(3) is set to 2900 rpm to 3100 rpm. That is, NE(1)<NE(3). NE(2) in FIG. 5 as well as KL(3) and KL(4) in FIG. 6 are also set appropriately.

In comparison between FIG. 5 and FIG. 6, NE(3) of the map for the cold state shown in FIG. 6 is greater than NE(1) of the map for the warm state shown in FIG. 5. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 110 (even if fuel is not injected from in-cylinder injector 110). Thus, the region where fuel injection is to be carried out using intake manifold injector 120 can be expanded, whereby homogeneity is improved.

In comparison between FIG. 5 and FIG. 6, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is Kl(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possibly to obtain a homogeneous air-fuel mixture using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decrease at the compression end, so that the anti-knocking performance is improved. Further, since the temperature within the combustion chamber is decreased, intake efficiency improves, leading to high power.

In the map for the warm state in FIG. 5, fuel injection is also carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, in which case accumulation of deposits is prevented. Further, clogging at in-cylinder injector 110 may be prevented while ensuring the minimum fuel injection quantity thereof Thus, in-cylinder injector 110 solely is used in the relevant region.

In comparison between FIG. 5 and FIG. 6, the region of "DI RATIO r=0%" is present only in the map for the cold state of FIG. 6. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary. Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

<Engine (2) to Which Present Control Apparatus is Suitably Adapted>

An engine (2) to which the control apparatus of the present embodiment is suitably adapted will be described hereinafter. In the following description of the engine (2), the configurations similar to those of the engine (1) will not be repeated.

Figure 7:
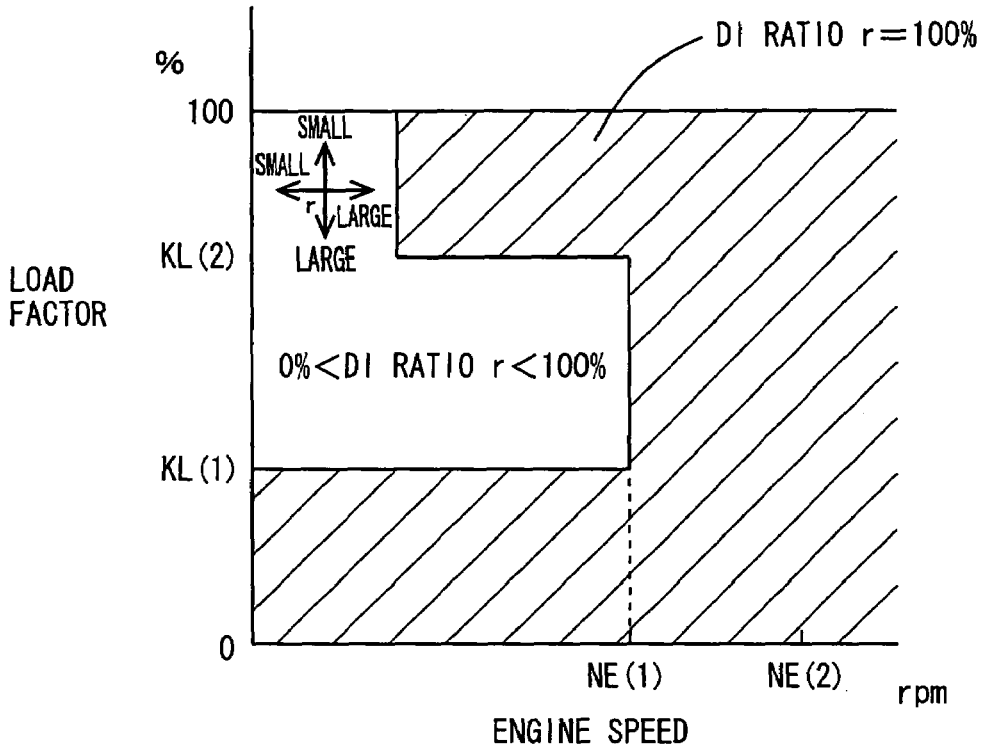
FIG. 7 represents a DI ratio map corresponding to a warm state of an engine to which the control apparatus of an embodiment of the present invention is suitably adapted.
Figure 8:
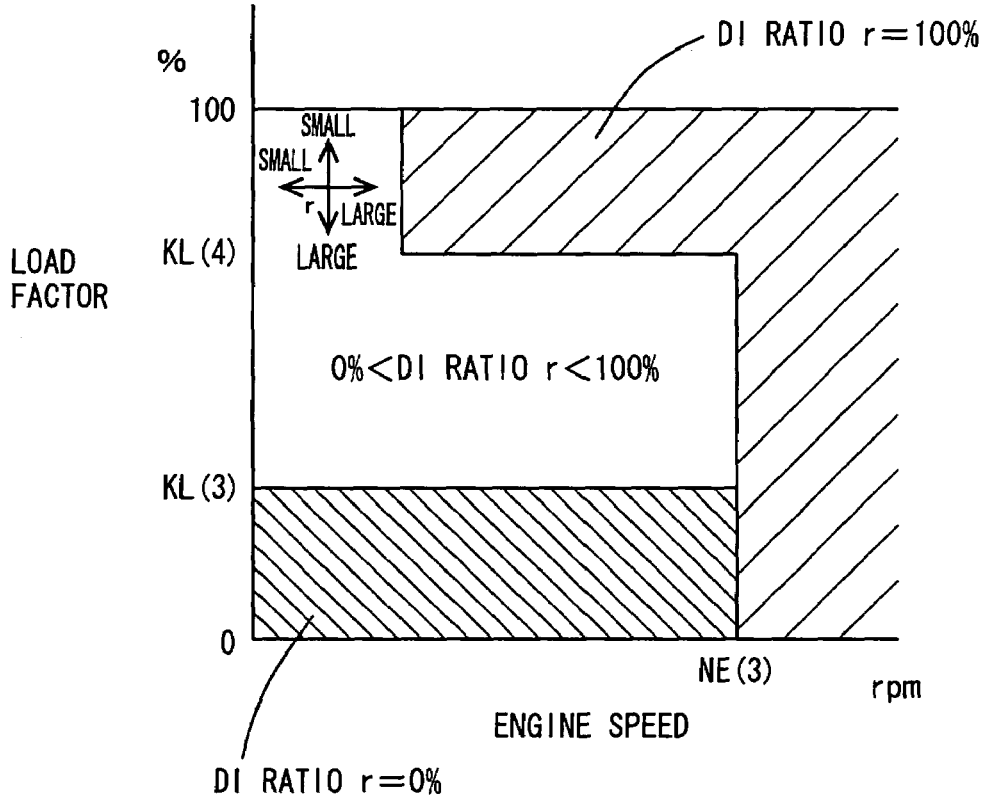
FIG. 8 represents a DI ratio map corresponding to a cold state of an engine to which the control apparatus of an engine of the present invention is suitably adapted

Referring to FIGS. 7 and 8, maps indicating the fuel injection ratio between in-cylinder injector 110 and intake manifold injector 120 identified as information associated with the operation state of engine 10 will be described. The maps are stored in ROM 320 of an engine ECU 300. FIG.

7 is the map for the warm state of engine 10, and FIG. 8 is the map for the cold state of engine 10.

FIGS. 7 and 8 differ from FIGS. 5 and 6 in the following points. "DI RATIO r=100%" holds in the region where the engine speed of engine 10 is equal to or higher than NE(1) in the map for the warm state, and in the region where the engine speed is NE(3) or higher in the map for the cold state. Further, "DI RATIO r=100%" holds in the region, excluding the low-speed region, where the load factor is KL(2) or greater in the map for the warm state, and in the region, excluding the low-speed region, where the load factor is KL(4) or greater in the map for the cold state. This means that fuel injection is carried out through in-cylinder injector 110 alone in the region where the engine speed is at a predetermined high level, and that fuel injection is often carried out through in-cylinder injector 110 alone in the region where the engine load is at a predetermined high level. However, in the low-speed and high-load region, mixing of an air-fuel mixture produced by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed increases where such a problem is unlikely to occur, whereas the fuel injection ratio of in-cylinder injector 110 is decreased as the engine load increases where such a problem is likely to occur. These changes in the DI ratio r are shown by crisscross arrows in FIGS. 7 and 8. In this manner, variation in output torque of the engine attributable to the unstable combustion can be suppressed. It is noted that these measures are substantially equivalent to the measures to decrease the fuel injection ratio of in-cylinder injector 110 in connection with the state of the engine moving towards the predetermined low speed region, or to increase the fuel injection ratio of in-cylinder injector 110 in connection with the engine state moving towards the predetermined low load region. Further, in a region other than the region set forth above (indicated by the crisscross arrows in FIGS. 7 and 8) and where fuel injection is carried out using only in-cylinder injector 110 (on the high speed side and on the low load side), the air-fuel mixture can be readily set homogeneous even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, whereby the antiknock performance is improved. Further, with the decreased temperature of the combustion chamber, intake efficiency improves, leading to high power output.

In the engine described in conjunction with FIGS. 5–8, the fuel injection timing of in-cylinder injector 110 is preferably achieved in the compression stroke, as will be described hereinafter. When the fuel injection timing of in-cylinder injector 110 is set in the compression stroke, the air-fuel mixture is cooled by the fuel injection while the temperature in the cylinder is relatively high. Accordingly, the cooling effect is enhanced to improve the antiknock performance. Further, when the fuel injection timing of in-cylinder injector 110 is set in the compression stroke, the time required starting from fuel injection to ignition is short, which ensures strong penetration of the injected fuel. Therefore, the combustion rate is increased. The improvement in antiknock performance and the increase in combustion rate can prevent variation in combustion, and thus, combustion stability is improved.

<Modification of Present Embodiment>

A control apparatus according to a modification of the present invention will be described here. The structure of the engine system under control of ECU 300 of the control apparatus of the present modification is similar to that shown in FIG. 1. Therefore, detailed description thereof will not be repeated. The present modification is characterized in that the operation region of engine 10 is restricted based on the temperature of in-cylinder injector 110.

Figure 9:
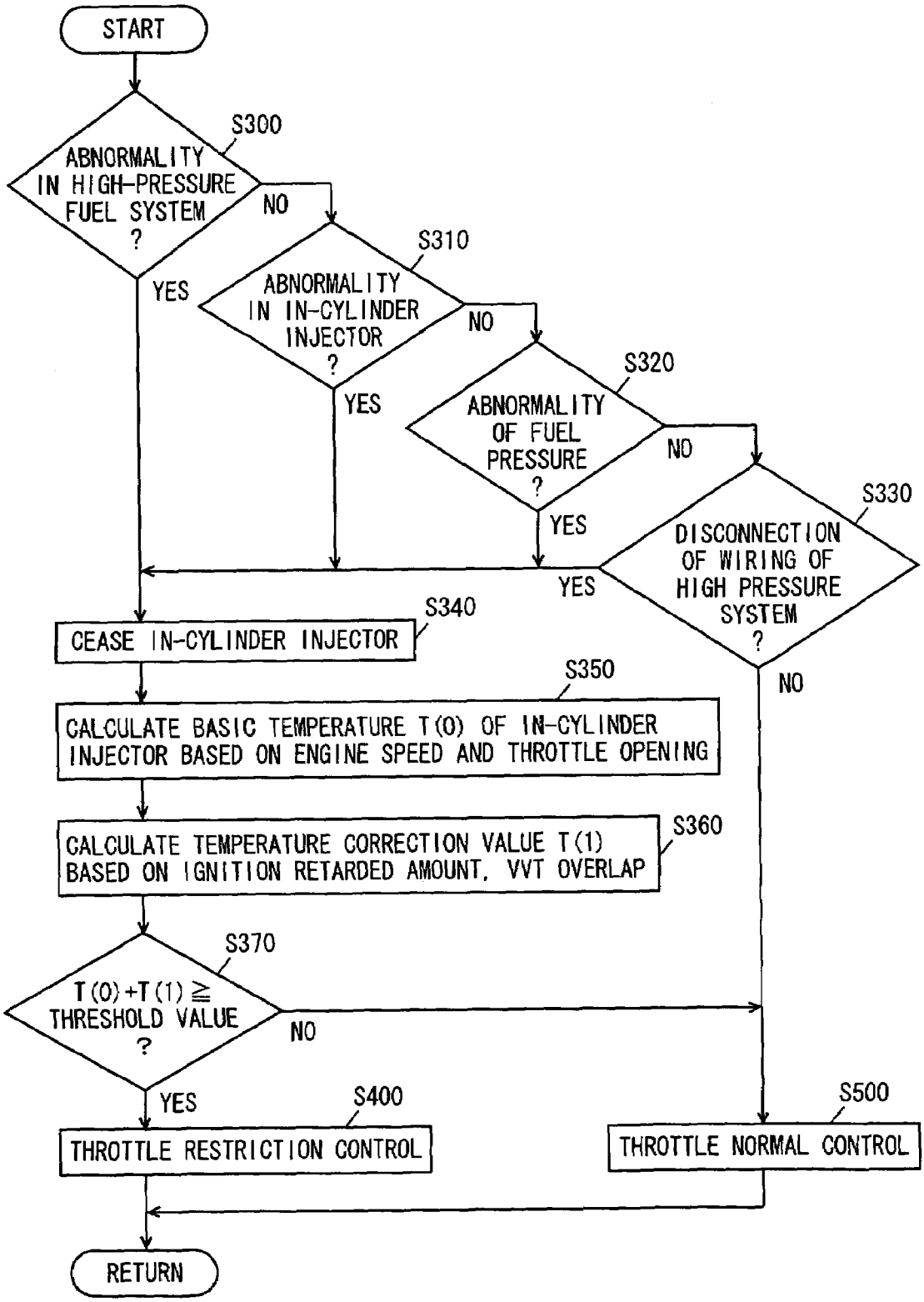
FIG. 9 is a flow chart of a control structure of a program executed by an engine ECU identified as the control apparatus according to a modification of an embodiment of the present invention.

A control structure of a program executed by engine ECU 300 identified as the control apparatus of the present modification will be described with reference to FIG. 9. The program of this flow chart is executed at a predetermined interval of time, or at a predetermined crank angle of engine 10.

At S300, engine ECU 300 determines whether abnormality in the high-pressure fuel system is sensed or not. When abnormality in the high-pressure fuel system is sensed (YES at S300), control proceeds to S340, otherwise (NO at S300), control proceeds to S310.

At S310, engine ECU 300 determines whether abnormality in in-cylinder injector 110 is sensed or not. When abnormality of in-cylinder injector 110 is sensed (YES at S310), control proceeds to S340, otherwise (NO at S310), control proceeds to S320.

At S320, engine ECU 300 determines whether abnormality of fuel pressure is sensed or not. For example, abnormality of fuel pressure is sensed when in-cylinder injector 110 cannot inject fuel even at the feed pressure. Upon sensing abnormality of fuel pressure (YES at S320), control proceeds to S340, otherwise (NO at S320), control proceeds to S330.

At S330, engine ECU 300 determines whether the wiring of the high pressure system is disconnected (for example, disconnection of the harness or the like that transmits a control signal to in-cylinder injector 110). When determination is made that the wiring of the high pressure system is disconnected (YES at S330), control proceeds to S340, otherwise (NO at S330), control proceeds to S500.

At S340, engine ECU 300 inhibits fuel injection from in-cylinder injector 110.

At S350, engine ECU 300 calculates the basic temperature T (0) of in-cylinder injector 110 based on engine speed NE and the opening of throttle valve 70. This basic temperature T (0) is the estimated temperature of in-cylinder injector 110 when correction that will be described afterwards is not taken into account.

At S360, engine ECU 300 calculates a temperature correction value T (1) based on the ignition retarded amount, and VVT overlap. When the overlap of the intake valves and exhaust valves by VVT is great, the internal EGR is increased, and combustion temperature is reduced. When the ignition timing is retarded, the combustion temperature is reduced. Therefore, when the overlap of VVT or the ignition timing is modified (retarded) towards reduction of the combustion temperature, T (1) becomes negative.

At S370, engine ECU 300 determines whether the value of adding temperature correction value T (1) to basic temperature T (0) is equal to or greater than a threshold value. When the value is equal to or greater than the threshold value (YES at S370), control proceeds to S400, otherwise (NO at S370), control proceeds to S500. The value of (basic temperature T (0)+temperature correction value T (1)) is eventually the estimated temperature of in-cylinder injector 110. When this estimated temperature is equal to or greater than a threshold value corresponding to the tolerable temperature to avoid failure caused by thermal factors when a proper in-cylinder injector 110 is ceased, the output of engine 10 is restricted to avoid any further increase in temperature. The failure at this stage is attributed to inhibition of cooling of in-cylinder injector 110 that was generally effected by fuel injection since fuel injection from in-cylinder injector 110 is ceased. Such failure includes clogging of the injection hole caused by accumulation of deposits in the proximity of the injection hole, excess of the heat-resisting temperature of in-cylinder injector 110 itself, and the like. An actually measured temperature of in-cylinder injector 110 (temperature at the leading end) may be employed instead of the estimated temperature of in-cylinder injector 110.

At S400, engine ECU 300 restricts the opening of throttle valve 70. This implies that the output of engine 10 is restricted. Accordingly, the intake air quantity is reduced, and output of engine 10 is restricted. This prevents excessive increase of the combustion temperature. Therefore, increase of temperature at the leading end of in-cylinder injector 110 can be suppressed, and induction of secondary failure caused by accumulation of deposits at the injection hole of in-cylinder injector 110 can be obviated.

At S500, engine ECU 300 controls throttle valve 70 in a normal manner.

The operation of engine 10 under control of engine ECU 300 identified as the control apparatus for an internal combustion engine according to the present modification based on the structure and flow chart set forth above will be described here.

When the high-pressure fuel system fails (YES at S300), when at least one of in-cylinder injectors 110 fails (YES at S310), when abnormality of the fuel pressure is sensed (YES at S320), or when the wiring of the high pressure system is disconnected (YES at S330), fuel injection from in-cylinder injector 110 is ceased (S340).

The basic temperature T (0) of in-cylinder injector 110 is calculated on the basis of engine speed NE and the throttle opening. A temperature correction value T (1) is calculated to take into consideration the factors of increase or decrease of temperature with respect to basic temperature T (0) (S360). Temperature correction value T (1) is added to basic temperature T (0) to calculate the estimated temperature of in-cylinder injector 110. Since secondary failure of in-cylinder injector 110 caused by thermal factors may be induced if the estimated temperature is as high as the threshold value, the opening of throttle valve 70 is restricted to restrict the output of engine 10. Accordingly, excessive increase in temperature of in-cylinder injector 110 is obviated to suppress secondary failure of in-cylinder injector 110.

When in-cylinder injector 110 is ceased in the present modification, secondary failure of in-cylinder injector 110 can be obviated as will be set forth below in addition to restricting the opening of throttle valve 70.

Figure 10:
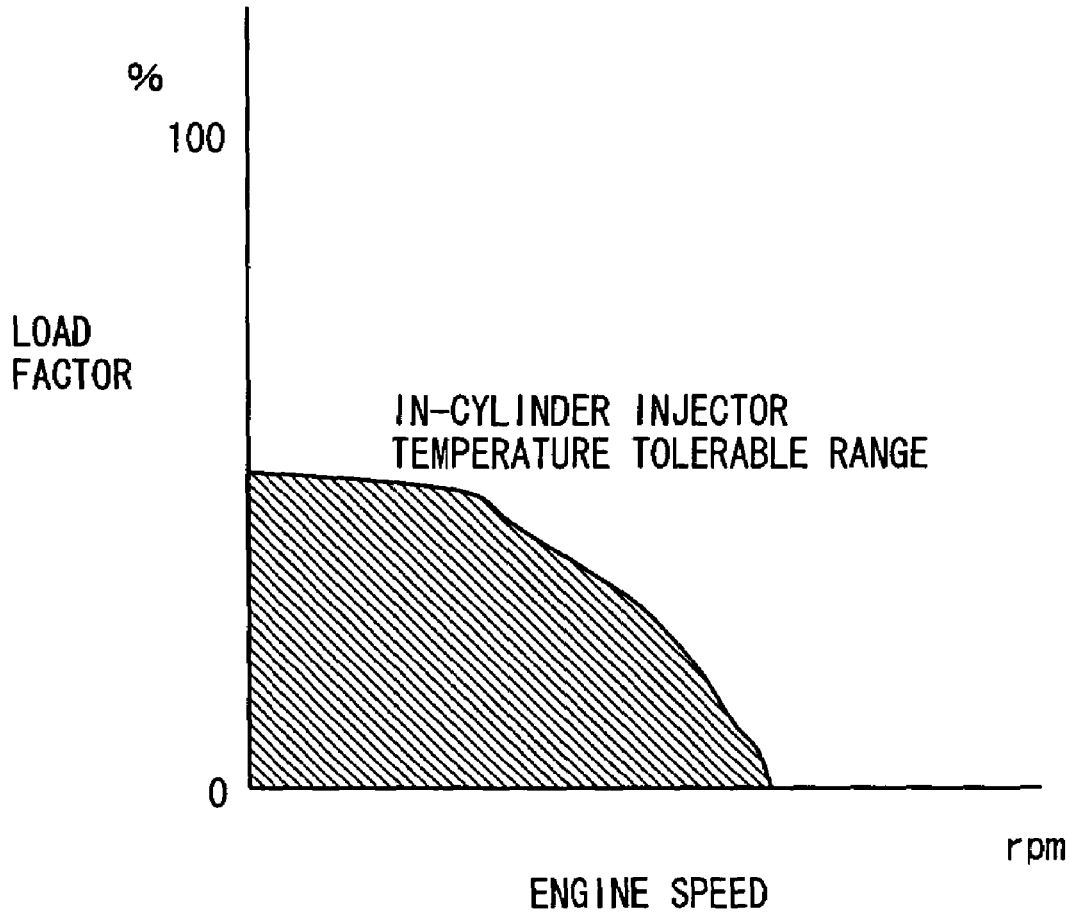
FIG. 10 represents a temperature tolerable region of an in-cylinder injector according to the modification of an embodiment of the present invention.

As shown in FIG. 10, the temperature tolerable range for in-cylinder injector 110 is determined in advance based on engine speed NE and the load factor. The engine speed and the like are controlled such that engine 10 is operated within this region.

Although the present modification has been described in which in-cylinder injector 110 is ceased, the control apparatus of the present modification can be applied even in the case where in-cylinder injector 110 injects fuel at the feed pressure, as described with reference to FIG. 2.

The engine described with reference to FIGS. 5–8 is suitable for application of the control apparatus of the present modification.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including a first fuel injection mechanism injecting fuel into a cylinder, a second fuel injection mechanism injecting fuel into an intake manifold, a first fuel supply mechanism supplying fuel to said first fuel injection mechanism, and a second fuel supply mechanism supplying fuel to said first fuel injection mechanism and said second fuel injection mechanism, said control apparatus comprising:

a control unit controlling said first and second fuel injection mechanisms such that said first and second fuel injection mechanisms partake in fuel injection, including a state of injection from one of said first and second fuel injection mechanisms being ceased, a first abnormality determination unit determining presence of a failure in said first fuel supply mechanism to operate properly, and a second abnormality determination unit determining presence of a failure in said first fuel injection mechanism to operate properly, wherein said control unit effects control such that fuel is injected from at least said first fuel injection mechanism using said second fuel supply mechanism when said first abnormality determination unit determines failure in said first fuel supply mechanism to operate properly and said second abnormality determination unit does not determine presence of failure in said first fuel injection mechanism to operate properly.

2. The control apparatus for an internal combustion engine according to claim 1, wherein said control unit effects control such that fuel supply from said first fuel injection mechanism is ceased when said first abnormality determination unit determines presence of failure in said first fuel supply mechanism to operate properly, and said second abnormality determination unit determines presence of failure in said first fuel injection mechanism to operate properly.

3. The control apparatus for an internal combustion engine according to claim 1, further comprising an adjustment unit adjusting a variable valve timing mechanism provided at said internal combustion engine such that, when said first abnormality determination unit determines presence of failure in said first fuel supply mechanism to operate properly, overlap of intake valves and exhaust valves is increased as compared to a case where determination is made of no failure in said first fuel supply mechanism to operate properly.

4. The control apparatus for an internal combustion engine according to claim 1, further comprising an adjustment unit adjusting ignition timing such that, when said first abnormality determination unit determines presence of failure in said first fuel supply mechanism to operate properly, the ignition timing is retarded as compared to a case where determination is made of no failure in said first fuel supply mechanism to operate properly.

5. The control apparatus for an internal combustion engine according to claim 1, further comprising a restriction unit restricting an output of said internal combustion engine such that deposits are not accumulated at an injection hole of said first fuel injection mechanism.

6. The control apparatus for an internal combustion engine according to claim 5, wherein said restriction unit modifies restriction of the output of said internal combustion engine between an event of ceasing fuel injection from said first fuel injection mechanism and an event of conducting fuel injection from said first fuel injection mechanism using said second fuel supply mechanism to restrict the output of said internal combustion engine.

7. The control apparatus for an internal combustion engine according to claim 6, wherein said restriction unit modifies restriction of the output of said internal combustion engine to become stricter when fuel supply from said first fuel injection mechanism is ceased than in a case where fuel injection is conducted from said first fuel injection mechanism using said second fuel supply mechanism to restrict the output of said internal combustion engine.

8. The control apparatus for an internal combustion engine according to claim 1, wherein the temperature of said internal combustion engine is reduced by said control unit when the temperature of said first fuel injection mechanism is at least a predetermined temperature.

9. The control apparatus for an internal combustion engine according to claim 1, wherein said first fuel injection mechanism is an in-cylinder injector, and said second fuel injection mechanism is an intake manifold injector.

10. A control apparatus for an internal combustion engine including a first fuel injection mechanism injecting fuel into a cylinder and a second fuel injection mechanism injecting fuel into an intake manifold, said control apparatus comprising:

an injection control unit controlling said first and second fuel injection mechanisms such that said first and second fuel injection mechanisms partake in fuel injection, including a state of injection from one of said first and second fuel injection mechanisms being ceased, a sensing unit sensing that said first fuel injection mechanism has a failure and cannot operate properly, and a control unit controlling said internal combustion engine such that temperature in a cylinder of said internal combustion engine is reduced when said first fuel injection mechanism cannot operate properly.

11. The control apparatus for an internal combustion engine according to claim 10, wherein said control unit controls said internal combustion engine such that the temperature in a cylinder of said internal combustion engine is reduced based on the temperature of said first fuel injection mechanism.

12. The control apparatus for an internal combustion engine according to claim 11, wherein the temperature of said first fuel injection mechanism is calculated based on an engine speed and intake air quantity of said internal combustion engine.

13. The control apparatus for an internal combustion engine according to claim 11, wherein the temperature of said first fuel injection mechanism is calculated by temperature calculated based on the engine speed and intake air quantity of said internal combustion engine, and a temperature variation factor.

14. The control apparatus for an internal combustion engine according to claim 13, wherein said temperature variation factor includes a correction temperature calculated based on at least one of an overlapping amount of intake valves and exhaust valves and a retarded amount of ignition timing.

15. The control apparatus for an internal combustion engine according to claim 10, wherein said control unit controls said internal combustion engine such that the temperature in a cylinder of said internal combustion engine is reduced by restricting a quantity of intake air into said internal combustion engine.

16. The control apparatus for an internal combustion engine according to claim 10, wherein said control unit controls said internal combustion engine such that the temperature in a cylinder of said internal combustion engine is reduced by restricting an engine speed of said internal combustion engine.

17. The control apparatus for an internal combustion engine according to claim 10, wherein the temperature of said internal combustion engine is reduced by said control unit when the temperature of said first fuel injection mechanism is at least a predetermined temperature.

18. The control apparatus for an internal combustion engine according to claim 10, wherein said first fuel injection mechanism is an in-cylinder injector, and said second fuel injection mechanism is an intake manifold injector.

19. A control apparatus for an internal combustion engine including first fuel injection means for injecting fuel into a cylinder, second fuel injection means for injecting fuel into an intake manifold, first fuel supply means for supplying fuel to said first fuel injection means, and second fuel supply means for supplying fuel to said first fuel injection means and said second fuel injection means, said control apparatus comprising:

control means for controlling said first and second fuel injection means such that said first and second fuel injection means partake in fuel injection, including a state of injection from one of said first and second fuel injection means being ceased, first abnormality determination means for determining presence of a failure in said first fuel supply means to operate properly, and second abnormality determination means for determining presence of a failure in said first fuel injection means to operate properly, wherein said control means effects control such that fuel is injected from at least said first fuel injection means using said second fuel supply means when said first abnormality determination means determines failure in said first fuel supply means to operate properly and said second abnormality determination means does not determine presence of failure in said first fuel injection means to operate properly.

20. The control apparatus for an internal combustion engine according to claim 19, wherein said control means includes means for effecting control such that fuel supply from said first fuel injection means is ceased when said first abnormality determination means determines presence of failure in said first fuel supply means to operate properly, and said second abnormality determination means determines presence of failure in said first fuel injection means to operate properly.

21. The control apparatus for an internal combustion engine according to claim 19, further comprising means for adjusting a variable valve timing mechanism provided at said internal combustion engine such that, when said first abnormality determination means determines presence of failure in said first fuel supply means to operate properly, overlap of intake and exhaust valves is increased as compared to a case where determination is made of no failure in said first fuel supply means to operate properly.

22. The control apparatus for an internal combustion engine according to claim 19, further comprising means for adjusting ignition timing such that, when said first abnormality determination means determines presence of failure in said first fuel supply means to operate properly, the ignition timing is retarded as compared to a case where determination is made of no failure in said first fuel supply means to operate properly.

23. The control apparatus for an internal combustion engine according to claim 19, further comprising restriction means for restricting an output of said internal combustion engine such that deposits are not accumulated at an injection hole of said first fuel injection means.

24. The control apparatus for an internal combustion engine according to claim 23, wherein said restriction means includes means for modifying restriction of the output of said internal combustion engine between an event of ceasing fuel injection from said first fuel injection means and an event of conducting fuel injection from said first fuel injection means using said second fuel supply means for restricting the output of said internal combustion engine.

25. The control apparatus for an internal combustion engine according to claim 24, wherein said restriction means includes means for modifying restriction of the output of said internal combustion engine to become stricter when fuel supply from said first fuel injection means is ceased than in a case where fuel injection is conducted from said first fuel injection means using said second fuel supply means for restricting the output of said internal combustion engine.

26. The control apparatus for an internal combustion engine according to claim 19, wherein the temperature of said internal combustion engine is reduced by said control means when the temperature of said first fuel injection means is at least a predetermined temperature.

27. The control apparatus for an internal combustion engine according to claim 19, wherein said first fuel injection means is an in-cylinder injector, and said second fuel injection means is an intake manifold injector.

28. A control apparatus for an internal combustion engine including first fuel injection means for injecting fuel into cylinder and second fuel injection means for injecting fuel into an intake manifold, said control apparatus comprising:

injection control means for controlling said first and second fuel injection means such that said first and second fuel injection means partake in fuel injection, including a state of injection from one of said first and second fuel injection means being ceased, sensing means for sensing that said first fuel injection means has a failure and cannot operate properly, and control means for controlling said internal combustion engine such that temperature in a cylinder of said internal combustion engine is reduced when said first fuel injection means cannot operate properly.

29. The control apparatus for an internal combustion engine according to claim 28, wherein said control means includes means for controlling said internal combustion engine such that the temperature in a cylinder of said internal combustion engine is reduced, based on the temperature of said first fuel injection means.

30. The control apparatus for an internal combustion engine according to claim 29, wherein the temperature of said first fuel injection means is calculated based on an engine speed and intake air quantity of said internal combustion engine.

31. The control apparatus for an internal combustion engine according to claim 29, wherein the temperature of said first fuel injection means is calculated by temperature calculated based on the engine speed and intake air quantity of said internal combustion engine, and a temperature variation factor.

32. The control apparatus for an internal combustion engine according to claim 31, wherein said temperature variation factor includes a correction temperature calculated based on at least one of an overlapping amount of intake and exhaust valves and a retarded amount of ignition timing.

33. The control apparatus for an internal combustion engine according to claim 28, wherein said control means includes means for controlling said internal combustion engine such that the temperature in a cylinder of said internal combustion engine is reduced by restricting a quantity of intake air into said internal combustion engine.

34. The control apparatus for an internal combustion engine according to claim 28, wherein said control means includes means for controlling said internal combustion engine such that the temperature in a cylinder of said internal combustion engine is reduced by restricting an engine speed of said internal combustion engine.

35. The control apparatus for an internal combustion engine according to claim 28, wherein the temperature of said internal combustion engine is reduced by said control means when the temperature of said first fuel injection means is at least a predetermined temperature.

36. The control apparatus for an internal combustion engine according to claim 28, wherein said first fuel injection means is an in-cylinder injector, and said second fuel injection means is an intake manifold injector.

* * * * *